US012329339B2

(12) United States Patent
Zhou et al.

(10) Patent No.: US 12,329,339 B2
(45) Date of Patent: Jun. 17, 2025

(54) ENERGY-SAVING DISHWASHER AND CONTROL METHOD THEREFOR

(71) Applicant: INNOVATION RESEARCH INSTITUTE OF ZHEJIANG UNIVERSITY OF TECHNOLOGY, SHENGZHOU, Zhejiang (CN)

(72) Inventors: Shuiqing Zhou, Zhejiang (CN); Ding Xia, Zhejiang (CN); Yu Luo, Zhejiang (CN); Xi Jin, Zhejiang (CN); Zijian Mao, Zhejiang (CN); Tianle Zhang, Zhejiang (CN)

(73) Assignee: INNOVATION RESEARCH INSTITUTE OF ZHEJIANG UNIVERSITY OF TECHNOLOGY, SHENGZHOU, Zhejiang (CN)

( * ) Notice: Subject to any disclaimer, the term of this patent is extended or adjusted under 35 U.S.C. 154(b) by 0 days.

(21) Appl. No.: 18/359,903

(22) Filed: Jul. 27, 2023

(65) Prior Publication Data

US 2024/0049940 A1 Feb. 15, 2024

Related U.S. Application Data

(63) Continuation of application No. PCT/CN2023/101667, filed on Jun. 21, 2023.

(30) Foreign Application Priority Data

Aug. 10, 2022 (CN) ..... 202210959362.8

(51) Int. Cl.
*A47L 15/00* (2006.01)
*A47L 15/16* (2006.01)
(Continued)

(52) U.S. Cl.
CPC ..... *A47L 15/0047* (2013.01); *A47L 15/0028* (2013.01); *A47L 15/0036* (2013.01);
(Continued)

(58) Field of Classification Search
CPC ..... A47L 15/0028; A47L 15/0036; A47L 15/0047; A47L 15/16; A47L 15/4214;
(Continued)

(56) References Cited

U.S. PATENT DOCUMENTS

2007/0235063 A1* 10/2007 Lee ..... F16L 37/086 134/25.2
2011/0247666 A1* 10/2011 Fiora ..... A47L 15/0015 134/56 D
(Continued)

FOREIGN PATENT DOCUMENTS

CN 107289431 A * 10/2017

OTHER PUBLICATIONS

Machine translation of CN107289431A (Year: 2017).*

*Primary Examiner* — Douglas Lee
(74) *Attorney, Agent, or Firm* — JCIPRNET

(57) ABSTRACT

Disclosed in the present invention are an energy-saving dishwasher and a control method therefor. The inner container is arranged inside the housing, the inner container is internally provided with a manifold type dish rack for placing dishes and spraying steam to perform steam cleaning on the dishes, and the manifold type dish rack is placed on a supporting frame fixed to the inner container. A water storage tank, a steam/hot water integrated generating device and a water pump are arranged below the inner container, and the steam/hot water integrated generating device includes a generating assembly and a control assembly. The manifold type dish rack is configured to place the dishes and simultaneously sprays steam to clean the dishes. The steam/
(Continued)

hot water integrated generating device is configured to generate steam and hot water, heating is performed to generate the steam, and then relative cooling is performed to generate the hot water.

9 Claims, 5 Drawing Sheets

(51) Int. Cl.
*A47L 15/42* (2006.01)
*A47L 15/46* (2006.01)
*A47L 15/50* (2006.01)

(52) U.S. Cl.
CPC ..... *A47L 15/16* (2013.01); *A47L 15/4214* (2013.01); *A47L 15/4234* (2013.01); *A47L 15/4244* (2013.01); *A47L 15/4287* (2013.01); *A47L 15/4289* (2013.01); *A47L 15/46* (2013.01); *A47L 15/50* (2013.01); *A47L 2401/09* (2013.01); *A47L 2401/12* (2013.01); *A47L 2401/14* (2013.01); *A47L 2401/17* (2013.01); *A47L 2501/01* (2013.01); *A47L 2501/02* (2013.01); *A47L 2501/06* (2013.01); *A47L 2501/14* (2013.01)

(58) Field of Classification Search
CPC ..... A47L 15/4234; A47L 15/4244; A47L 15/4285; A47L 15/4287; A47L 15/4289; A47L 15/46; A47L 15/50; A47L 2401/09; A47L 2401/12; A47L 2401/14; A47L 2401/17; A47L 2501/01; A47L 2501/02; A47L 2501/06; A47L 2501/14
See application file for complete search history.

(56) References Cited

U.S. PATENT DOCUMENTS

2016/0029869 A1* 2/2016 Mckinney ..... A47L 15/0034 134/21
2018/0213998 A1* 8/2018 Kim ..... A47L 15/0034

* cited by examiner

ENERGY-SAVING DISHWASHER AND CONTROL METHOD THEREFOR

CROSS-REFERENCE TO RELATED APPLICATION

This application is a continuation of international application of PCT application serial no. PCT/CN2023/101667 filed on Jun. 21, 2023, which claims the priority benefit of China application no. 202210959362.8 filed on Aug. 10, 2022. The entirety of each of the above mentioned patent applications is hereby incorporated by reference herein and made a part of this specification.

BACKGROUND

Technical Field

The present invention belongs to the technical field of dishwashers, and particularly relates to an energy-saving dishwasher and a control method therefor.

Description of Related Art

In recent years, with the improvement of people's living standards, dishwashers have gradually entered the public family and become a convenient tool for people to clean tableware. Water washing type dishwashers and steam dishwashers are common dishwashers on the market. A washing mode of the water washing type dishwasher is to spray high-pressure washing water by means of a spray system in the dishwasher to clean the tableware, and a washing manner of the steam dishwasher is mainly to soften and clear contaminants on the surface of the tableware by means of steam pretreatment. However, for the water washing type dishwasher, stubborn oil stains are difficult to be removed, and cleaning time is longer. For the steam dishwasher, steam is likely to condense in a transport pipeline, and both an air injection flow and a temperature will be reduced, which affects a cleaning effect.

Simple water washing or steam washing cannot achieve the desired cleaning effect. With the development of dishwasher technology, steam washing and water washing are combined to become a new cleaning manner. In the prior art, a steam spray device is usually arranged in an inner container space or a wall surface of an inner container, an effective use space of the inner container is seriously wasted in the former, and a large area of cleaning dead angle exists in the latter. Moreover, in the prior art, a steam generator and a hot water heating pipe need to be arranged separately, and hot water and steam each need to be heated and generated from cold water, such that space is occupied, and energy consumption is increased.

By means of the above analysis, problems and defects existing in the prior art are as follows.

(1) The existing steam spray device is usually arranged in the inner container space or the wall surface of the inner container, the effective use space of the inner container is seriously wasted in the former, and a large area of cleaning dead angle exists in the latter.

(2) In the prior art, the steam generator and the hot water heating pipe need to be arranged separately, and hot water and steam each need to be heated and generated from cold water, such that space is occupied, and energy consumption is increased.

SUMMARY

Aiming at the problems existing in the prior art, the present invention provides an energy-saving dishwasher and a control method therefor.

The present invention is implemented as follows: an energy-saving dishwasher and a control method therefor are provided. The energy-saving dishwasher includes:

a housing and an inner container.

The inner container is arranged inside the housing, the inner container is internally provided with a manifold type dish rack for placing dishes and spraying steam to perform steam cleaning on the dishes, and the manifold type dish rack is placed on a supporting frame fixed to the inner container.

The manifold type dish rack includes an air inlet pipe, an air injection pipe, a supporting pipe, and steam nozzles.

A water storage tank, a steam/hot water integrated generating device and a water pump are arranged below the inner container.

The steam/hot water integrated generating device includes a generating assembly and a control assembly.

The generating assembly is configured to generate steam and hot water, and supply the steam and hot water to the manifold type dish rack and a spray arm respectively for cleaning the dishes.

The control assembly is configured to monitor a water level, a temperature and an air pressure in the steam/hot water integrated generating device, and control a cleaning process.

Furthermore, a bottom of the inner container is provided with a filter for filtering residues.

Furthermore, the bottom of the inner container is provided with a float valve serving as a safety device to prevent overfilling of the dishwasher.

Furthermore, the housing includes a box body and a box door, where a handle and a control panel are arranged outside the box door, a detergent adding device is arranged inside the box door, and a water inlet and a drainage port are provided below a rear portion of the box body.

Furthermore, the air inlet pipe and the air injection pipe of the manifold type dish rack are hollow pipes, and the supporting pipe is a solid pipe.

Furthermore, the air injection pipe is a combination of a long straight pipe and a long corrugated pipe, the air injection pipe is provided with several steam nozzles, steam passes through the air inlet pipe to the air injection pipe and is sprayed out of the steam nozzles, and the supporting pipe is a combination of a long straight pipe and a short straight pipe and is configured to support the air injection pipe.

Furthermore, the generating assembly includes an outer cover, a sealing ring, a water input electromagnetic valve, a water inlet, a box body, a water outlet, a water output electromagnetic valve, a steam electromagnetic valve, a steam port, a filter screen, a heater, a baffle plate I, and a baffle plate II.

The water inlet and the water outlet are provided below the box body and connected to the water input electromagnetic valve and the water output electromagnetic valve respectively to control on-off and a flow rate of a water flow, and the steam port is provided at a center of the outer cover and connected to the steam electromagnetic valve to control on-off and a flow rate of the steam.

The filter screen is arranged at the steam port and is configured to prevent boiling liquid drops from entering the air inlet pipe, and the sealing ring is arranged between the outer cover and the box body and is configured to prevent steam leakage.

The heater is of a curved pipe structure and is arranged inside the box body, and two ends of the heater are fixedly connected to wall surfaces of the box body. The baffle plate I and the baffle plate II are of rectangular plate structures, are fixedly connected to another wall surfaces of the box body, and are provided with holes for the heater to pass through. The heater is combined with the baffle plate I and the baffle plate II to ensure that the water flow is fully heated in the device.

Furthermore, the control assembly includes a pressure sensor, a temperature sensor, a temperature controller, a pressure controller, a high liquid level sensor, and a low liquid level sensor.

The pressure sensor, the temperature sensor, the temperature controller, and the pressure controller are arranged on a wall surface of the box body, and are configured to control the cleaning process to ensure a safe operation of the energy-saving dishwasher.

Furthermore, the low liquid level sensor and the high liquid level sensor are arranged on the baffle plate I and the baffle plate II respectively and are configured to control a liquid level in the energy-saving dishwasher to prevent dry burning.

Another objective of the present invention is to provide a control method for an energy-saving dishwasher. The control method for an energy-saving dishwasher includes:

- starting the energy-saving dishwasher, closing the steam electromagnetic valve and the water output electromagnetic valve, opening the water input electromagnetic valve, and enabling the heater to start working at high power to generate the steam;
- when the steam in the generating device reaches a steam washing pressure, opening the steam electromagnetic valve, and enabling the manifold type dish rack to start spraying the steam to clean the dishes;
- keeping the steam spraying operation for a period of time, closing the steam electromagnetic valve to complete steam cleaning, and enabling the heater to continue performing heating;
- when the steam in the generating device reaches a water washing pressure, opening the water output electromagnetic valve, enabling the heater to work at low power, and enabling the spray arm to spray hot water for cleaning;
- after cleaning is completed, stopping the heater, closing the water output electromagnetic valve and the water input electromagnetic valve, opening the steam electromagnetic valve, and discharging remaining steam; and
- after the steam is exhausted, cooling the heater, closing the steam electromagnetic valve, opening the water output electromagnetic valve, and after water is drained by means of a drainage pipeline, closing the water output electromagnetic valve to finish cleaning.

In combination with the above technical solutions and the technical problems to be solved, the advantages and positive effects of the technical solutions to be protected by the present invention are analyzed from the following aspects:

Firstly, in view of the above-mentioned technical problems existing in the prior art and the difficulty of solving these problems, how to solve these technical problems in the technical solutions of the present invention, and some creative technical effects brought after these problems are solved are profoundly analyzed in detail in close combination with the technical solutions to be protected by the present invention, and the results, data, etc. in the research and development process. Specific description is as follows:

According to the present invention, the manifold type dish rack is configured to place the dishes and simultaneously can spray steam to clean the dishes, thereby saving an effective use space inside the dishwasher and reducing a cleaning dead angle.

According to the present invention, the steam/hot water integrated generating device is configured to generate the steam and hot water, firstly, heating is performed to generate the steam, and then relative cooling is performed to generate the hot water, thereby saving the space and energy consumption.

Secondly, by taking the technical solutions as a whole or from the point of view of a product, the technical effects and advantages of the technical solutions to be protected by the present invention are specifically described as follows:

A cleaning manner of combining steam washing and hot water washing is employed in the present invention, which is easier to clear stubborn oil stains and higher in cleaning efficiency. The effective use space of the inner container is saved, a steam cleaning range is enlarged, and the energy consumption is saved.

DESCRIPTION OF THE EMBODIMENTS

Figure 1:
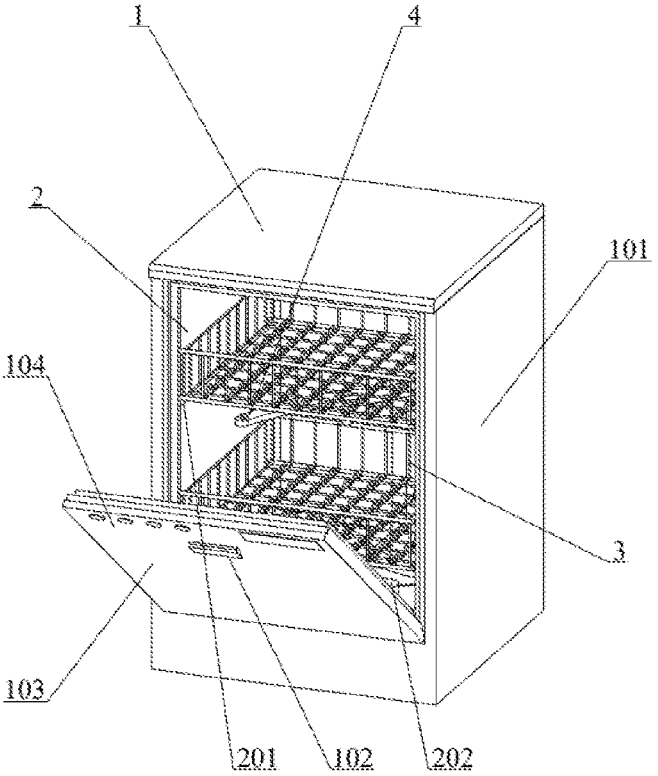
FIG. 1 is a schematic structural diagram of an energy-saving dishwasher provided by an embodiment of the present invention.
Figure 2:
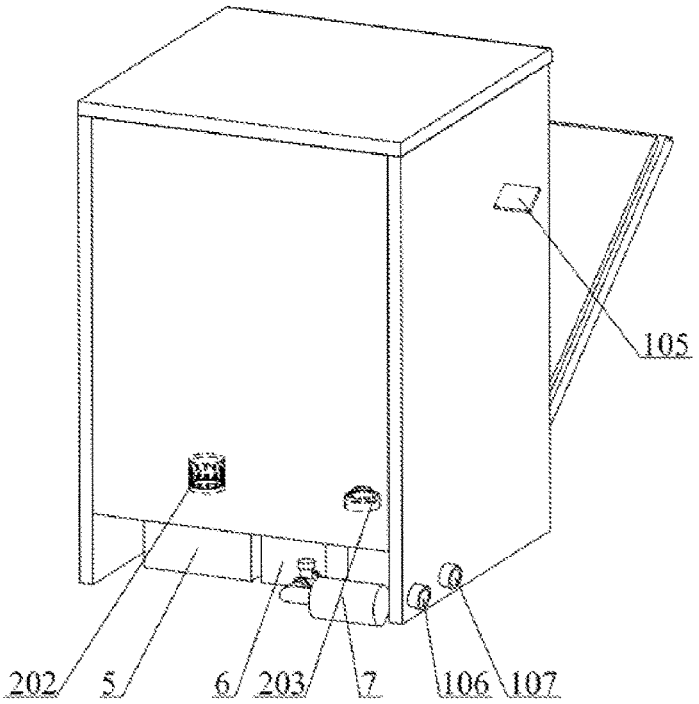
FIG. 2 is a structural diagram from a back view of an energy-saving dishwasher provided by an embodiment of the present invention.
Figure 3:
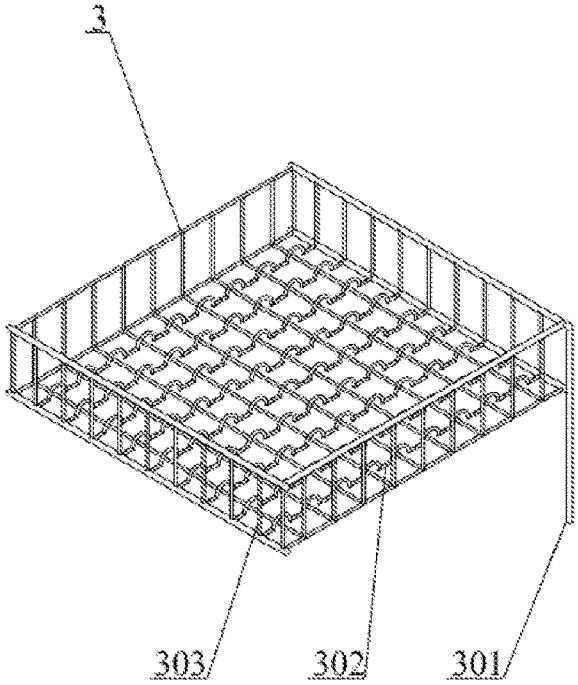
FIG. 3 is a schematic structural diagram of a manifold type dish rack provided by an embodiment of the present invention.
Figure 4:
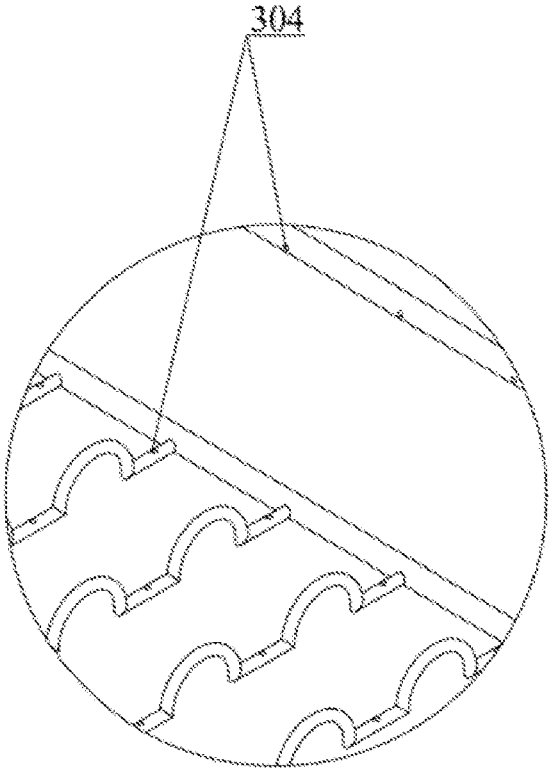
FIG. 4 is an enlarged schematic diagram of a steam nozzle of a manifold type dish rack provided by an embodiment of the present invention.
Figure 5:
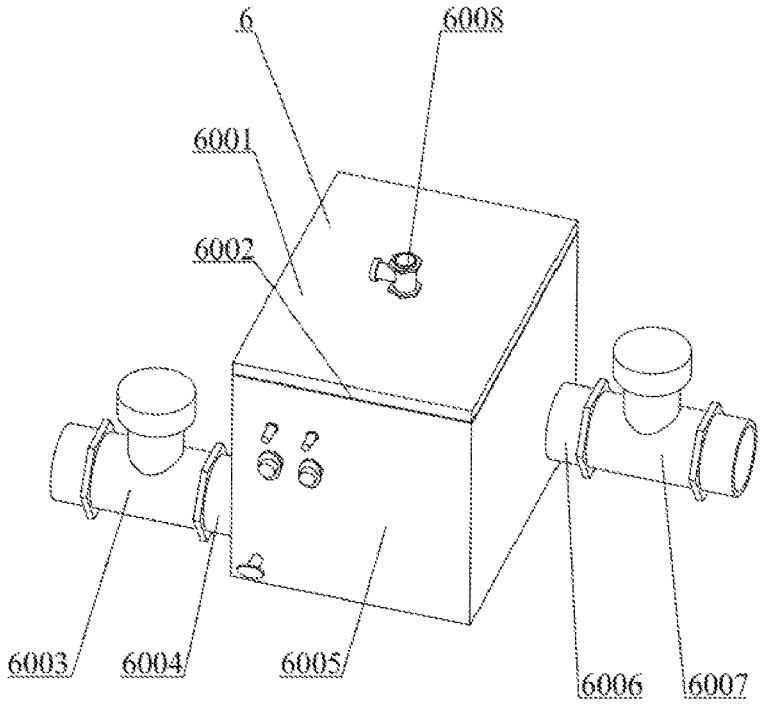
FIG. 5 is a schematic structural diagram of a steam/hot water integrated generating device provided by an embodiment of the present invention.
Figure 6:
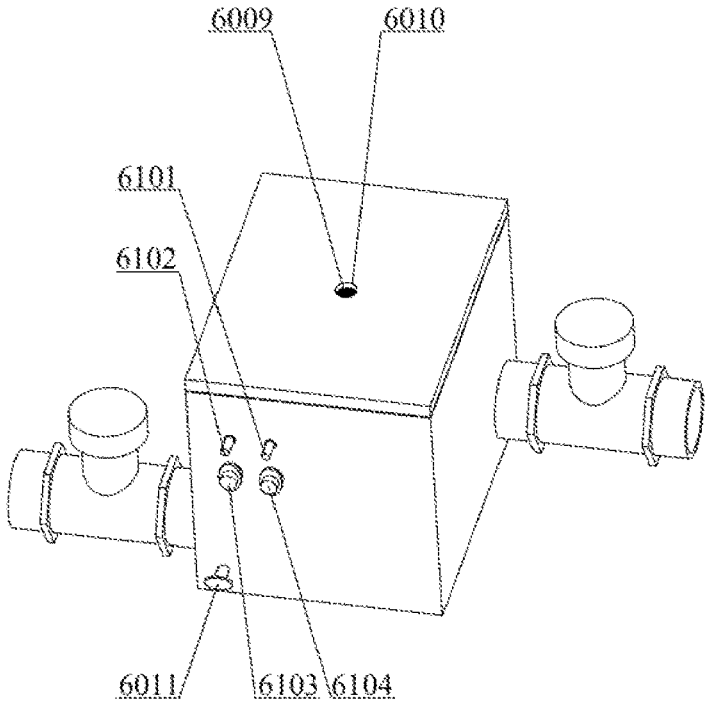
FIG. 6 is a schematic structural diagram of a steam port provided by an embodiment of the present invention.
Figure 7:
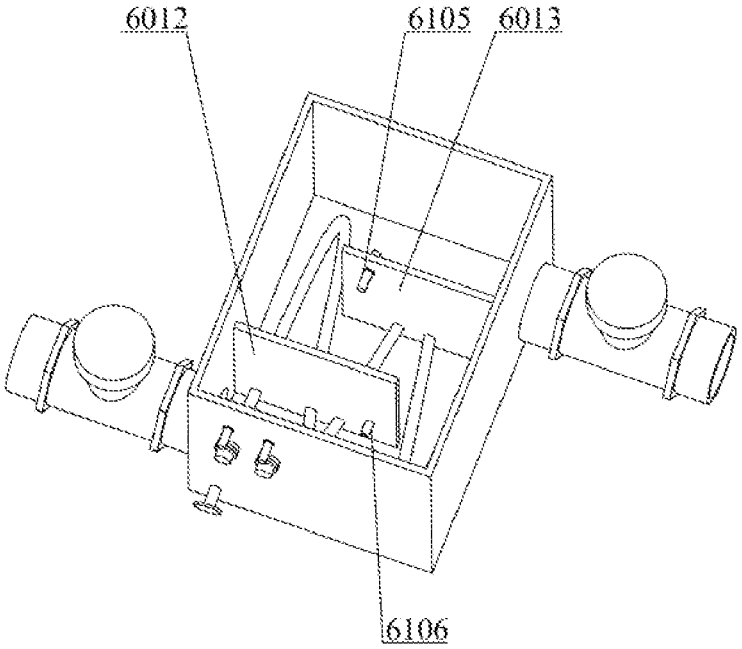
FIG. 7 is a schematic structural diagram of a baffle plate provided by an embodiment of the present invention.
Figure 8:
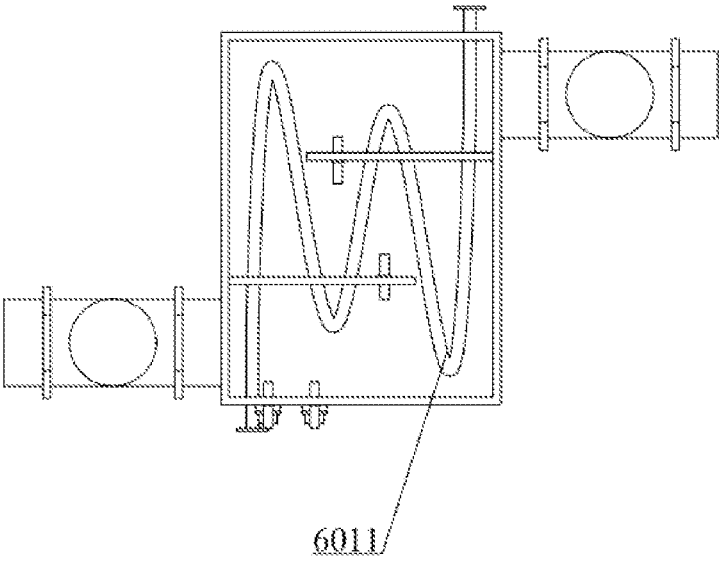
FIG. 8 is a schematic structural diagram of a heater provided by an embodiment of the present invention.

In order to make the objective, the technical solutions and the advantages of the present invention clearer, the present invention is further described in detail below with reference to the embodiments. It should be understood that the particular embodiments described herein are merely illustrative of the present invention and are not intended to limit the present invention.

In order to enable those skilled in the art to fully understand how the present invention is concretely implemented, an explanatory embodiment is provided for describing the technical solutions of the claims in detail.

As shown in FIG. 1 to FIG. 8, an energy-saving dishwasher provided by the present invention includes a housing 1, and an inner container 2, a manifold type dish rack 3, a spray arm 4, a water storage tank 5, a steam/hot water integrated generating device 6 and a water pump 7 are arranged to cooperate with the housing 1.

The housing 1 includes a box body 101, a front portion of the box body is provided with a box door 103 which is in close fit with the box body. A handle 102 and a control panel 104 are arranged outside the box door 103, a detergent adding device 105 is arranged inside the box door, and a water inlet 106 and a drainage port 107 are provided below a rear portion of the box body 101.

The inner container 2 is internally provided with the manifold type dish rack 3, and the manifold type dish rack 3 is placed on a supporting frame 201 fixed to the inner container 2. A bottom of the inner container 2 is provided with a filter 202 for filtering residues, etc., the bottom of the inner container 2 is provided with a float valve 203 serving as a safety device to prevent overfilling of the dishwasher, and the water storage tank 5, the steam/hot water integrated generating device 6 and the water pump 7 are arranged below the inner container 2.

The manifold type dish rack 3 includes an air inlet pipe 301, an air injection pipe 302, a supporting pipe 303 and steam nozzles 304.

The steam/hot water integrated generating device 6 includes a generating assembly and a control assembly, where the generating assembly is configured to generate steam and hot water, and supply the steam and hot water to the manifold type dish rack 3 and the spray arm 4 respectively for cleaning the dishes, and the control assembly is configured to monitor a water level, a temperature and an air pressure in the steam/hot water integrated generating device 6, thereby achieving the effects of controlling a cleaning process and guaranteeing safe operation of the device.

The manifold type dish rack 3 is included, the air inlet pipe 301 and the air injection pipe 302 are hollow pipes, and the supporting pipe 303 is a solid pipe.

The air injection pipe 302 is a combination of a long straight pipe and a long corrugated pipe, the air injection pipe 302 is provided with a large number of steam nozzles 304, steam passes through the air inlet pipe 301 to the air injection pipe 302 and is sprayed out of the steam nozzles 304, and the supporting pipe 303 is a combination of a long straight pipe and a short straight pipe and is configured to support the air injection pipe 302, thereby guaranteeing stability of the structure.

The generating assembly in the embodiment of the present invention includes an outer cover 6001, a sealing ring 6002, a water input electromagnetic valve 6003, a water inlet 6004, a box body 6005, a water outlet 6006, a water output electromagnetic valve 6007, a steam electromagnetic valve 6008, a steam port 6009, a filter screen 6010, a heater 6011, a baffle plate I 6012, and a baffle plate II 6013.

The water inlet 6004 and the water outlet 6006 are provided below the box body 6005 and connected to the water input electromagnetic valve 6003 and the water output electromagnetic valve 6007 respectively to control on-off and a flow rate of a water flow, and the steam port 6009 is provided at a center of the outer cover 6001 and connected to the steam electromagnetic valve 6008 to control on-off and a flow rate of the steam.

The filter screen 6010 is arranged at the steam port 6009 and is configured to prevent boiling liquid drops from entering the air inlet pipe 301, and the sealing ring 6002 is arranged between the outer cover 6001 and the box body 6005 and is configured to prevent steam leakage.

The heater 6011 is of a curved pipe structure and is arranged inside the box body 6005, and two ends of the heater are fixedly connected to wall surfaces of the box body 6005. The baffle plate I 6012 and the baffle plate II 6013 are of rectangular plate structures, are fixedly connected to another wall surfaces of the box body 6005, and are provided with holes for the heater 6011 to pass through. The heater 6011 is combined with the baffle plate I 6012 and the baffle plate II 6013 to ensure that the water flow is fully heated in the device.

The control assembly in the embodiment of the present invention includes a pressure sensor 6101, a temperature sensor 6102, a temperature controller 6103, a pressure controller 6104, a high liquid level sensor 6105, and a low liquid level sensor 6106.

The pressure sensor 6101, the temperature sensor 6102, the temperature controller 6103, and the pressure controller 6104 are arranged on the wall surface of the box body 6005, and are configured to control the cleaning process to ensure safe operation of the device.

The low liquid level sensor 6105 and the high liquid level sensor 6106 are arranged on the baffle plate I 6012 and the baffle plate II 6013 respectively and are configured to control a liquid level in the device to prevent dry burning.

Figure 9:
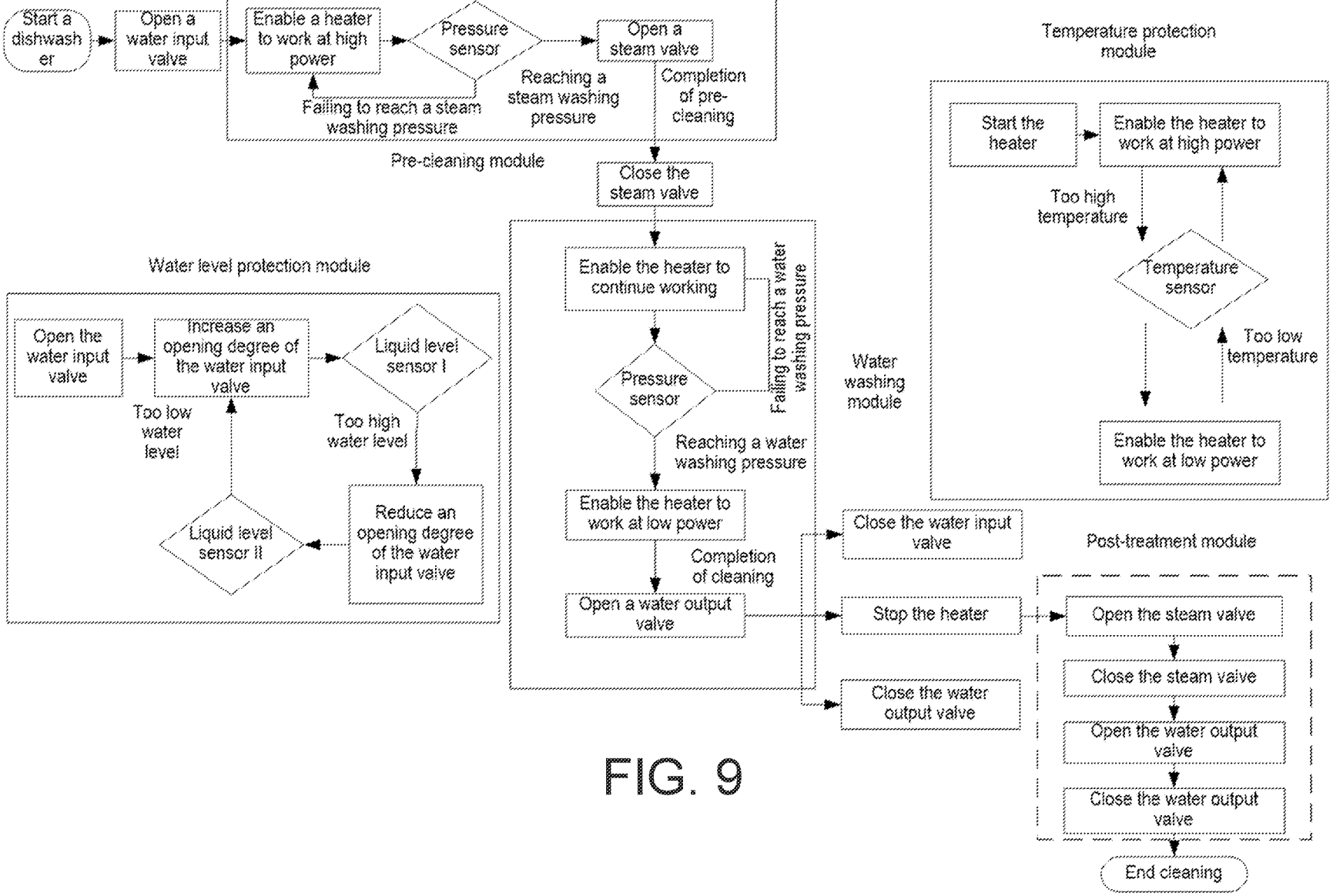
FIG. 9 is a flow chart of a control method for an energy-saving dishwasher provided by an embodiment of the present invention.

As shown in FIG. 9, a control method for an energy-saving dishwasher provided by the embodiment of the present invention is as follows:

- start the dishwasher, close the steam electromagnetic valve 6008 and the water output electromagnetic valve 6007, open the water input electromagnetic valve 6003, and enable the heater 6011 to start working at high power to generate steam;
- when the steam in the generating device reaches a steam washing pressure, open the steam electromagnetic valve 6008, and enable the manifold type dish rack 3 to start spraying the steam to clean the dishes;
- keep the steam spraying operation for a period of time, close the steam electromagnetic valve 6008 to complete steam cleaning, and enable the heater 6011 to continue performing heating;
- when the steam in the generating device reaches a water washing pressure, open the water output electromagnetic valve 6007, enable the heater 6011 to work at low power, and enable the spray arm 4 to sprays hot water for cleaning;
- after cleaning is completed, stop the heater 6011, close the water output electromagnetic valve 6007 and the water input electromagnetic valve 6003, open the steam electromagnetic valve 6008, and discharge remaining steam; and
- after the steam is exhausted, cooling the heater 6011, close the steam electromagnetic valve 6008, open the water output electromagnetic valve 6007, and after water is drained by means of a drainage pipeline, close the water output electromagnetic valve 6007 to finish cleaning.

In the description of the present invention, unless otherwise stated, it should be noted that the term "multiple" means two or more, and orientations or positional relationships indicated by the terms "up", "down", "left", "right", "inner", "outer", "front end", "rear end", "the head", "the tail", etc. are based on the orientations or positional relationships shown in the accompanying drawings and are only for facilitating the description of the present invention and simplifying the description, rather than indicating or implying that a device or element referred to must have a particular orientation or be constructed and operated in a particular orientation, and therefore will not be interpreted as limiting the present invention. Moreover, the terms "first", "second", "third", etc. are merely for descriptions and may not be understood as indication or implication of relative importance.

What are described above are merely particular embodiments of the present invention, but a protection scope of the present invention is not limited thereto, and any modifications, equivalent substitutions and improvements that are made by any of those skilled in the art and familiar with the technical field within the technical scope disclosed by the present invention and within the spirit and principle of the present invention should be covered within the protection scope of the present invention.

What is claimed is:

1. An energy-saving dishwasher, comprising:

a housing and an inner container, wherein the inner container is arranged inside the housing, the inner container is internally provided with a manifold type dish rack for placing dishes and spraying a steam to perform steam cleaning on the dishes, and the manifold type dish rack is placed on a supporting frame fixed to the inner container;

the manifold type dish rack comprises an air inlet pipe, an air injection pipe, a supporting pipe, and steam nozzles;

a water storage tank, a steam/hot water integrated generating device and a water pump are arranged below the inner container;

the steam/hot water integrated generating device comprises a generating assembly and a control assembly;

the generating assembly is configured to generate the steam and hot water, and supply the steam and hot water to the manifold type dish rack and a spray arm respectively for cleaning the dishes;

the control assembly is configured to monitor a water level, a temperature and an air pressure in the steam/hot water integrated generating device, and control a cleaning process;

the generating assembly comprises an outer cover, a sealing ring, a water input electromagnetic valve, a water inlet, a box body, a water outlet, a water output electromagnetic valve, a steam electromagnetic valve, a steam port, a filter screen, a heater, a baffle plate I, and a baffle plate II;

the water inlet and the water outlet are provided below the box body of the generating assembly and are connected to the water input electromagnetic valve and the water output electromagnetic valve respectively to control on-off and a flow rate of a water flow, and the steam port is provided at a center of the outer cover and is connected to the steam electromagnetic valve to control on-off and a flow rate of the steam;

the filter screen is arranged at the steam port and is configured to prevent boiling liquid drops from entering the air inlet pipe, and the sealing ring is arranged between the outer cover and the box body of the generating assembly and is configured to prevent steam leakage; and the heater is of a curved pipe structure and is arranged inside the box body of the generating assembly, and two ends of the heater are fixedly connected to wall surfaces of the box body of the generating assembly; the baffle plate I and the baffle plate II are of rectangular plate structures, are fixedly connected to another wall surfaces of the box body of the generating assembly, and are provided with holes for the heater to pass through; and the heater is combined with the baffle plate I and the baffle plate II to ensure that the water flow is fully heated in the device.

2. The energy-saving dishwasher according to claim 1, wherein a bottom of the inner container is provided with a filter for filtering residues.

3. The energy-saving dishwasher according to claim 1, wherein a bottom of the inner container is provided with a float valve serving as a safety device to prevent overfilling of the dishwasher.

4. The energy-saving dishwasher according to claim 1, wherein the housing comprises a box body and a box door, a handle and a control panel are arranged outside the box door, a detergent adding device is arranged inside the box door, and a water inlet and a drainage port are provided below a rear portion of the box body of the housing.

5. The energy-saving dishwasher according to claim 1, wherein the air inlet pipe and the air injection pipe of the manifold type dish rack are hollow pipes, and the supporting pipe is a solid pipe.

6. The energy-saving dishwasher according to claim 5, wherein the air injection pipe is a combination of a long straight pipe and a long corrugated pipe, the air injection pipe is provided with the steam nozzles, steam passes through the air inlet pipe to the air injection pipe and is sprayed out of the steam nozzles, and the supporting pipe is a combination of a long straight pipe and a short straight pipe and is configured to support the air injection pipe.

7. The energy-saving dishwasher of claim 1, wherein the control assembly comprises a pressure sensor, a temperature sensor, a temperature controller, a pressure controller, a high liquid level sensor, and a low liquid level sensor, and the pressure sensor, the temperature sensor, the temperature controller, and the pressure controller are arranged on a wall surface of the box body of the generating assembly and are configured to control the cleaning process to ensure a safe operation of the energy-saving dishwasher.

8. The energy-saving dishwasher according to claim 7, wherein the low liquid level sensor and the high liquid level sensor are arranged on the baffle plate I and the baffle plate II respectively and are configured to control a liquid level in the energy-saving dishwasher to prevent dry burning.

9. A control method for the energy-saving dishwasher according to claim 1, comprising:

starting the energy-saving dishwasher, closing the steam electromagnetic valve and the water output electromagnetic valve, opening the water input electromagnetic valve, and enabling the heater to start working at high power to generate the steam;

when the steam in the generating device reaches a steam washing pressure, opening the steam electromagnetic valve, and enabling the manifold type dish rack to start spraying the steam to clean the dishes;

keeping a steam spraying operation for a period of time, closing the steam electromagnetic valve to complete steam cleaning, and enabling the heater to continue performing heating;

when the steam in the generating device reaches a water washing pressure, opening the water output electromagnetic valve, enabling the heater to work at low power, and enabling the spray arm to spray hot water for cleaning;

after cleaning is completed, stopping the heater, closing the water output electromagnetic valve and the water input electromagnetic valve, opening the steam electromagnetic valve, and discharging remaining steam; and after the steam is exhausted, cooling the heater, closing the steam electromagnetic valve, opening the water output electromagnetic valve, and after water is drained by means of a drainage pipeline, closing the water output electromagnetic valve to finish cleaning.

* * * * *